US008636216B1

(12) United States Patent
Mikami

(10) Patent No.: US 8,636,216 B1
(45) Date of Patent: Jan. 28, 2014

(54) CLOTH CONTAINER AND STATIONARY SCANNER HAVING THE SAME

(71) Applicant: NEC Infrontia Corporation, Kawasaki (JP)

(72) Inventor: Hayato Mikami, Kanagawa (JP)

(73) Assignee: NEC Infrontia Corporation, Tokyo (JP)

( * ) Notice: Subject to any disclaimer, the term of this patent is extended or adjusted under 35 U.S.C. 154(b) by 0 days.

(21) Appl. No.: 13/753,939

(22) Filed: Jan. 30, 2013

(30) Foreign Application Priority Data

Jul. 26, 2012 (JP) ..... 2012-165406

(51) Int. Cl.
*G06K 7/10* (2006.01)

(52) U.S. Cl.
USPC ..... 235/454; 235/375

(58) Field of Classification Search
USPC ..... 235/375, 380, 462, 454
See application file for complete search history.

(56) References Cited

U.S. PATENT DOCUMENTS 7,255,271 B2 * 8/2007 Ulrich et al. ..... 235/383

FOREIGN PATENT DOCUMENTS

| | | | |
|---|---|---|---|
| JP | 53-100826 | U | 8/1978 |
| JP | 60-87087 | U | 6/1985 |
| JP | 2001-306179 | A | 11/2001 |
| JP | 2007-108868 | A | 4/2007 |

* cited by examiner

*Primary Examiner* — Michael G Lee
*Assistant Examiner* — Tabitha Chedekel
(74) *Attorney, Agent, or Firm* — Sughrue Mion, PLLC

(57) ABSTRACT

The invention provides an easy-to-clean cloth container and a stationary scanner having such a cloth container. This cloth container is to be attached to a support post of a stationary scanner, and has a first component and a second component. The first component has a cloth storing space and a first engaging portion, and the second component has an attachment portion to be attached to the support post, and a second engaging portion. The first component is attached to the outside of the support post by detachably engaging the first engaging portion with the second engaging portion with the second component.

4 Claims, 3 Drawing Sheets

CLOTH CONTAINER AND STATIONARY SCANNER HAVING THE SAME

This application is based upon and claims the benefit of priority from Japanese patent application No. 2012-165406, filed on Jul. 26, 2012, the disclosure of which is incorporated herein in its entirety by reference.

BACKGROUND OF THE INVENTION

This invention relates to a cloth container and a stationary scanner having the same.

A point of sales (POS) system is conventionally known in which one sales clerk registers commodities purchased by a customer while another clerk performs accounting work. A stationary scanner used for the registration of commodities is known from Japanese Laid-Open Patent Publication No. 2007-108868 (Patent Document 1), for example, which is mounted on sacker table or the like and has a support post for supporting a display of various types and a keyboard for inputting commodity information.

A stationary scanner of this type may be provided with a space by forming a recess in a lower part of the support post to extend inward so that this space can be used as a cloth container in which a cloth to be used by a salesclerk is stored.

SUMMARY OF THE INVENTION

The cloth container of the conventional stationary scanner as described above is formed as a recess extending inward in a lower part of the support post which is located below an operator's (clerk's) line of sight. This makes it difficult for a clerk or the like to clean the cloth container in an appropriate manner. Additionally, it is also made difficult to visually check the inner surface of the cloth container, which causes a problem that stain or dirt adhered on the inner surface of the cloth container is apt to be overlooked and it is difficult to keep the cloth container and a cloth stored therein in hygienically clean conditions.

Therefore, an object of the invention is to solve these problems of the related art, that is, to provide a cloth container which is easy to clean and a stationary scanner having such a cloth container.

The invention provides a cloth container to achieve the aforementioned object. The cloth container according to the invention is a cloth container attached to a support post of a stationary scanner, and has a first component and a second component. The first component has a cloth storing space and a first engaging portion, and the second component has an attachment portion attached to the support post and a second engaging portion. The first component is attached to the outside of the support post by detachably engaging the first engaging portion with the second engaging portion of the second component.

The invention also provides a stationary scanner to achieve the aforementioned object. The stationary scanner according to the invention has the above-described cloth container, a scanner for reading a commodity code, and a support post for supporting the scanner, and the cloth container is attached to the support post.

The cloth container according to the invention employs a configuration in which the first component having the cloth storing space is attached to the outside of the support post, whereby even with the first component attached to the support post, the cloth storing space can be easily cleaned in an appropriate manner and stain or dirt on the inner surface of the cloth storing space can be easily found and cleaned up. Thus, the cloth storing space and the cloth can be kept hygienically clean.

Further, according to the invention, the first component having the cloth storing space is detachably attached to the second component attached to the support post, whereby the detachment of the first component from the second component is made easy, and thus the cloth storing space can be kept hygienically clean by washing the detached first component with water or the like.

DESCRIPTION OF THE EXEMPLARY EMBODIMENTS

An exemplary embodiment of a stationary scanner according to the invention will be described with reference to the accompanying drawings.

A stationary scanner 10 according to this embodiment is configured to be usable for registration of commodities in a point of sales (POS) system in which one salesclerk registers commodities purchased by a customer while another salesclerk performs accounting work.

Figure 1:
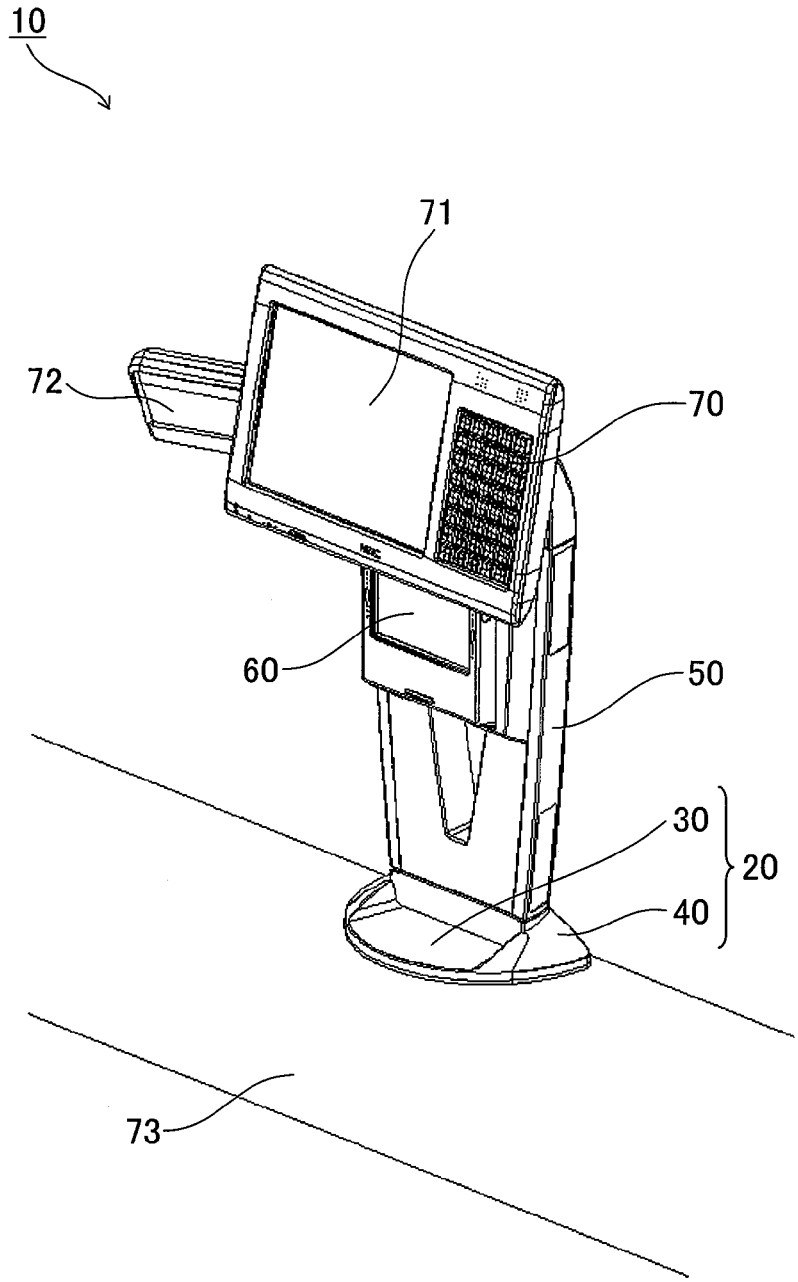
FIG. 1 is a perspective view showing a stationary scanner according to an embodiment of the invention.

As shown in FIG. 1, the stationary scanner 10 has a scanner 60 such as a CCD (Charge Coupled Device) image sensor for reading a commodity code attached to each commodity, a keyboard 70 for receiving various types of input, a salesclerk display 71 with a touch panel, a customer display 72, and a support post 50 supporting these components. Reference numeral 73 in FIGS. 1 and 5 denotes a sacker table on which the stationary scanner 10 is mounted.

As shown in FIG. 1, the stationary scanner 10 further has, in a lower part of the support post 50, a cloth container 20 for storing a cloth (e.g. table cleaning cloth) to be used by a clerk or the like for various purposes.

Figure 5:
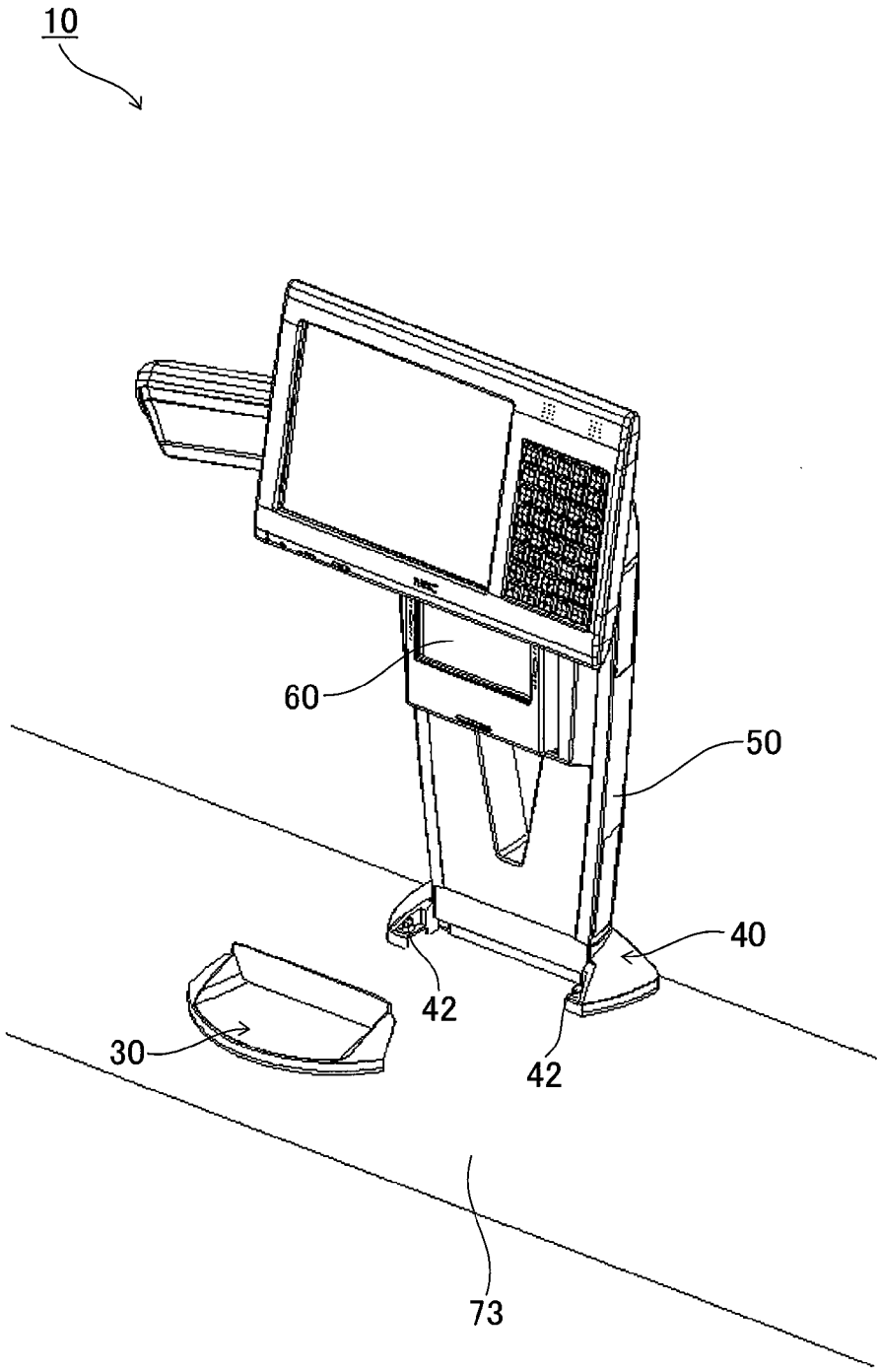
FIG. 5 is a perspective view showing the stationary scanner with the first component removed.

As shown in FIGS. 1 and 5, the cloth container 20 is composed of a first component 30 made of a resin and arranged on the front side of the support post 50 so as to project outward from the support post 50, and a second component 40 made of a resin and arranged on the back side of the support post 50. The first component 30 and the second component 40 are arranged to surround the support post 50.

Figure 2:
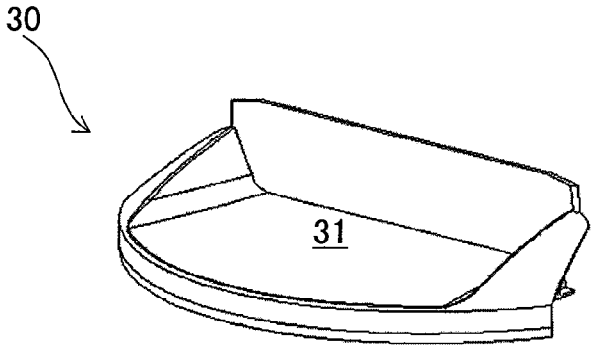
FIG. 2 is a perspective view showing a first component forming a cloth container.
Figure 3:
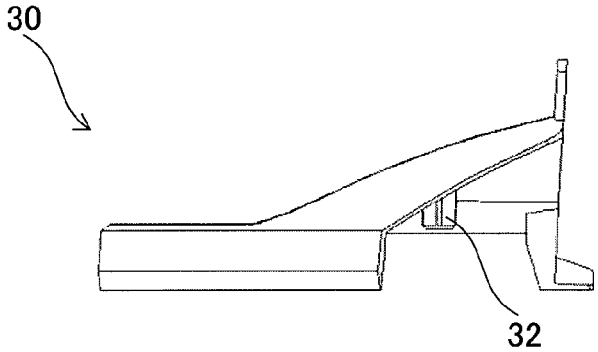
FIG. 3 is a side view of the first component.

As shown in FIG. 2, the first component 30 has, on the upper face thereof, a tray-shaped cloth storing space 31 for storing a cloth. As shown in FIG. 3, the first component 30 further has, on the lower face thereof, a pair of convex first engaging portions 32 to be detachably engaged with second engaging portions 42 of the second component 40.

As shown in FIG. 1, the first component 30 is arranged on the front side of the support post 50 where the scanner 60 is attached, that is, on the working space side where the salesclerk operates the stationary scanner 10. This arrangement allows the salesclerk to take out the cloth from the cloth storing space 31, to clean the cloth storing space 31, and to remove or attach the first component 30, from the side of the working space for the salesclerk.

Figure 4:
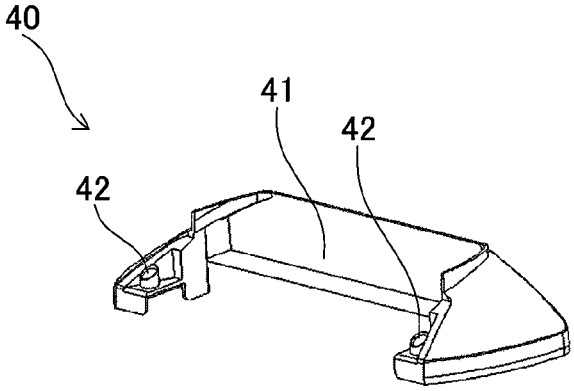
FIG. 4 is a perspective view showing a second component forming the cloth container.

As shown in FIG. 4, the second component 40 has an attachment portion 41 for attaching the second component 40 to the support post 50 by engaging the same with the support post 50, and a pair of concave second engaging portion 42 to be detachably engaged with the first engaging portions 32 of the first component 30.

In order to attach the first component 30 to the second component 40, as shown in FIG. 5, the first component 30 is brought from the above toward the second component 40 that is preliminarily attached to the supporting post 50, while aligning the concave second engaging portions 42 with the convex first engaging portions 32, and the first component 30 is fitted in the second component 40 fitted therein.

In order to detach the first component 30 from the second component 40, only the first component 30 is lifted up while pressing down the second component 40 with the operator's hand or the like so that the engagement between the concave second engaging portion 42 and the convex first engaging portion 32 is released, and the first component 30 is detached from the second component 40. The attachment and detachment can be done without using any fixing screws or tools.

The embodiment described above employs a configuration in which the first component 30 having the cloth storing space 31 is attached to a space defined in front and outside of the support post 50, whereby the cloth storing space 31 can be cleaned appropriately and easily even with the first component 30 attached to the support post 50. In addition, since stain or dirt on the inner surface of the cloth storing space 31 can be easily found, the cloth storing space 31 and the cloth can be kept hygienically clean.

Further, the first component 30 having the cloth storing space 31 is detachably attached to the second component 40 attached to the support post 50, which makes it possible to detach the first component 30 from the second component 40 so that the cloth storing space 31 can be easily kept hygienically clean by washing the detached first component 30 with water or the like.

Although the foregoing description of the embodiment has been made on the assumption that the first engaging portions 32 formed in the first component 30 are of a convex shape and the second engaging portions 42 formed in the second component 40 are of a concave shape, the specific shapes of the first engaging portions 32 and second engaging portions 42 are not limited particularly and the first and second engaging portions may assume any shapes as long as the first component 30 can be engaged with and attached to the second component 40 without the need of fixing screws or tools. For example, the first engaging portion 32 may be formed into a concave shape and the second engaging portion 42 may be formed into a convex shape.

What is claimed is:

1. A container for holding a cloth, the container attached to a support post of a stationary scanner which is to be placed on a table, the container comprising a first component and a second component, wherein: the first component is to be placed on the table and has a cloth storing space and a first engaging portion; the second component is also to be placed on the table and has an attachment portion attached to the support post and a second engaging portion; and the first component is attached to the outside of the support post on the table by detachably engaging the first engaging portion with the second engaging portion of the second component.

2. The container according to claim 1, wherein the storing space of the first component is formed into a tray shape so that the cloth is put thereon.

3. A stationary scanner mounted on a table and comprising a container according to claim 1, a scanner for reading a commodity code, and a support post for supporting the scanner on the table, the container being attached to the support post and placed on the table.

4. The stationary scanner according to claim 3, wherein the first component of the container is arranged on the table on the front side of the stationary scanner where the scanner is attached to the support post on the table, wherein the support post and the container are placed on the table.

* * * * *